United States Patent [19]

Schmeck

[11] Patent Number: 4,798,115

[45] Date of Patent: Jan. 17, 1989

[54] PNEUMATIC DRIVE FOR PUNCHING, CUTTING AND STAMPING DEVICES

[75] Inventor: Alfred Schmeck, Biedenkopf, Fed. Rep. of Germany

[73] Assignee: Kraemer & Grebe GmbH & Co. KG Maschinenfabrik, Biedenkopf-Wallau, Fed. Rep. of Germany

[21] Appl. No.: 58,469

[22] Filed: Jun. 5, 1987

[30] Foreign Application Priority Data

Jun. 12, 1986 [DE] Fed. Rep. of Germany ..... 3619811

[51] Int. Cl.[4] ..... B26D 5/12; B26D 5/04

[52] U.S. Cl. ..... 83/639; 83/554; 83/617; 92/62; 92/151

[58] Field of Search ..... 83/639, 617, 554; 92/62, 151; 72/453.02

[56] References Cited

U.S. PATENT DOCUMENTS

| | | | |
|---|---|---|---|
| 860,009 | 7/1907 | Becker | 83/639 |
| 897,048 | 8/1908 | Astfalck | 83/639 |
| 2,740,472 | 4/1956 | Eckstein et al. | 83/639 |
| 2,825,405 | 3/1958 | Maass et al. | 83/639 |
| 3,036,798 | 5/1962 | Martin | 83/639 |
| 3,371,569 | 3/1968 | Pearson et al. | 83/639 |
| 3,847,528 | 11/1974 | Farrell | 92/151 |
| 3,848,492 | 11/1974 | Vetter | 83/639 |
| 3,908,496 | 9/1975 | Moelbert | 83/639 |
| 3,991,639 | 11/1976 | Pfeifer | 83/554 |
| 4,186,649 | 2/1980 | Sundstrom | 92/62 |
| 4,583,436 | 4/1986 | Asano . | |

FOREIGN PATENT DOCUMENTS

| | | |
|---|---|---|
| 0249059 | 12/1987 | European Pat. Off. . |
| 3248574 | 7/1984 | Fed. Rep. of Germany . |
| 1353708 | 5/1974 | United Kingdom . |
| 2055667 | 3/1981 | United Kingdom . |

*Primary Examiner*—Donald R. Schran
*Assistant Examiner*—Scott A. Smith
*Attorney, Agent, or Firm*—Flynn, Thiel, Boutell & Tanis

[57] ABSTRACT

A pneumatic drive for punching, cutting and stamping devices, which have two tool parts which can be moved toward one another, and of which preferably one, at least in the operating position, is fixedly connected to the machine frame, is constructed such that an opening gap, which is as large as possible, is created. Furthermore, when the tool parts are moved together, the pneumatic drive is operated at a low pressure, so that additional safety devices are not needed. A pneumatic cylinder is secured on the movable tool part for this purpose, the piston rod of the pneumatic cylinder being constructed lockably in at least one end position. The piston rod of a pressure clamping element is secured on the piston rod exiting from the pneumatic cylinder. The cylinder of the pressure clamping element is arranged or fixably stationarily and consists of at least two piston cylinder units with one common piston rod, which piston cylinder units are connected one behind the other.

13 Claims, 6 Drawing Sheets

PNEUMATIC DRIVE FOR PUNCHING, CUTTING AND STAMPING DEVICES

FIELD OF THE INVENTION

The invention relates to a pneumatic drive for punching, cutting and stamping devices, comprising two tool parts which can be moved toward one another, and of which, preferably one, at least in the operating position, is fixedly connected to the machine frame, in particular for cutting devices for packaging machines with a large opening width.

BACKGROUND OF THE INVENTION

It is known in packaging machines to manufacture the packages of a lower and an upper foil, recesses being formed in the lower and/or the upper foil. The goods is then placed into the recesses of the lower foil and is sealed by means of the upper foil to create a finished package. Following this sealing operation, the packages are then separated from one another, which is done by means of a longitudinal and a transverse cutting device. The two tool parts must carry out a relatively large stroke during the transverse cutting of the packages, so that the tool parts can engage between the cuplike formed lower foil and the possibly also cuplike formed upper foil. If the upper foil is not profiled, then the upper tool part is fixedly connected to the machine frame and only the lower tool part is lifted and lowered. If the upper foil is profiled, then the upper part must also be lifted and lowered. The upper part is, in the cutting position, fixedly locked to the machine frame. It is known to use a pneumatic drive for driving the cutting device, whereby the pneumatic drive acts onto a toggle-lever arrangement, which presses the lower part against the upper part fixed on the machine frame. The toggle-lever arrangement is needed in order to be able to apply forces, which can be 9 t. and higher. The disadvantages of the toggle-lever arrangement consists in same being exposed to a relatively high wear, and the opening width of the machine parts being limited, since insufficient space exists below the foil for the arrangement of the complicated mechanism. Moreover, this construction is also complicated and susceptible to wear, since it consists of many individual parts.

Furthermore it is known to provide a hydraulic drive, with which the high cutting forces can be produced substantially easier. However, this hydraulic drive is particularly problematic because when it is used during packaging of foods or of pharmaceutical goods, doubts exist regarding a possible leakage of hydraulic oil. Moreover, the hydraulic aggregate is also complicated and expensive to manufacture and an additional energy medium is needed, which does not exist like pressurized air exists at any rate.

The basic purpose of the invention is to provide a drive for punching, cutting and stamping devices of the above-mentioned type so that they can be manufactured with an opening gap of any size, that they can be operated at a low pressure when moving the tool parts together, so that additional safety devices are not needed, that the drive being relatively small in construction is simple in design and economical to manufacture and that the drive can produce at the same time the respectively needed closing force and thus the cutting, stamping and punching force.

According to the invention, the pneumatic drive for punching, cutting and stamping devices thus consists of at least one pneumatic cylinder, which is connected to a movable tool part. The piston rod of the pneumatic cylinder is connected to a further piston rod of a second air pressure clamping element which is fixed on the machine frame. If a flat upper foil is used here, it can at all times be fixedly connected to the machine frame. Otherwise, it must also be constructed liftably and lowerably.

The compressed-air cylinder, which is connected to the movable tool part, can be constructed with the necessary length, so that the tool part takes up the needed opening gap for the further transport of the packages. The compressed-air cylinder can be loaded with a relatively low pressure, so that the force exerted by it lies below 15 kp., namely below a force at which no injuries are to be feared and thus additional safety devices are not needed. The piston rod is mechanically blocked at the end of the closing movement by means of the pneumatic cylinder, whereby the blocking device can be integrated inside of the pneumatic cylinder or, however, by means of a bolt, which is inserted into a recess of the piston rod and thus fixes it relative to the cylinder. The lower tool part rests in this closed position of the lower tool part with a contact pressure of less than 15 kp. on the knife. Subsequently, compressed air is applied to the pressure clamping element, so that the now locked piston rod s loaded with a large force, which may be 9 t. or more, and the knife is in this manner pressed against the abutment, so that the foil is separated. The pressure clamping element consists of several piston cylinder units which are connected in series, so that the diameter of the pressure clamping element is held relatively low during a high production of force. The path, which the pressure clamping element must cover, may then only be a few mm., which is for example by all means sufficient for cutting of a foil. The path, however, can also be increased at the expense of the structural height in order to be sufficient for example for stamping and punching devices.

The pressure clamping element consists preferably of several individual parts held pressed against one another annularly. The individual parts have a center bore, through which the piston rod extends. A cylindrically shaped shoulder arranged on the piston extends also through the center bore, whereby each piston is supported on the preceding and the next following piston, so that at a relatively small diameter with several pistons arranged one behind the other, a high pressure can be built up. The compressed air is supplied and discharged in the annular parts through bores which extend through the parts and lie one above the other after installation. Thus, it is possible to supply the plurality of piston units, which lie one behind the other, with two outside pneumatic connections.

Two drive units are preferably used for a cutting tool which is used for packaging machines. The drive units are arranged on both sides of the cutting device, and the two pressure clamping elements are connected through plates on which is secured the tool part carrying the knife.

Thus, an inventive device makes it possible to create opening gaps of any size between the two tool parts, which are limited only by the height of the machine frame. The inventive device consists of comparatively few individual parts, which can be manufactured inexpensively and thus results in a very economical construction, which operates wear-free but still delivers the necessary great contact pressure Since, moreover, a moving together of the two tool parts occur with a relatively low pressure, not only a safety device is not needed, but also the air consumption as such is significantly reduced. The actual working stroke which is driven with a high air pressure, is thus limited to a minimum, so that the device as a whole operates very economically.

Figure 1:
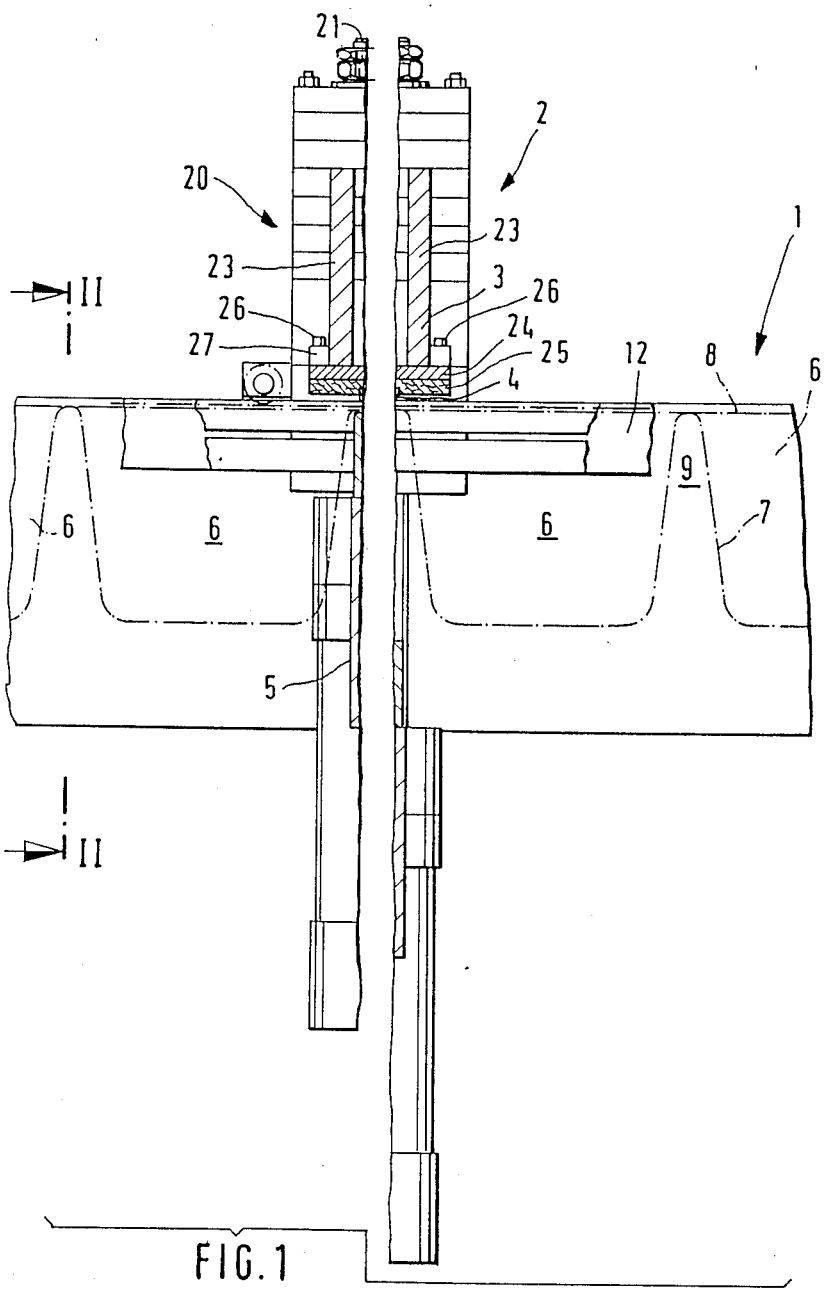
FIG. 1 is a longitudinal cross-sectional view of an inventive cutting device, in a packaging apparatus.

The drawings illustrate a cutting device 2 of a packaging apparatus 1 which has an upper tool part 3, which carries the knife 4, and a lower tool part 5 which serves as an abutment for the knife 4.

FIG. 1 is a side and cross-sectional view of a container 6 consisting of a lower foil 7, formed like a cup, and an upper foil 8. Upper and lower foil have been welded together in a conventional manner in a sealing station arranged in front of the cutting station. The containers 6 are separated in a transverse direction in the region of the space 9 existing between the containers.

The upper foil 8 is flat in the illustrated exemplary embodiment, so that the upper tool part 3 can be connected stationarily to a machine frame 10. Two guide bars 11 each are arranged on the inside of the machine frame 10. This can be seen in particular in FIGS. 2 and 3. The guide bars 11 receive guide profiles 12 which have a recess conforming to the guide bars 11. The guide profiles can be adjusted along the machine frame 10 so that, depending on the respective sizes of the containers 6, the cutting device 2 can be adjusted accordingly. A tooth system 13 exists for this purpose on the upper side of the guide bars 11. A gear 14, arranged rotatably on the machine frame 10, engages the tooth system 13. The two gears, which each engage the guide bar 11 on the two sides of the foils 7,8, are connected by a shaft 15, so that a canting is avoided during a movement of the cutting device 2. A handwheel 16 is fixedly secured to and against a relative rotation with respect to one end of the shaft 15. The handwheel 16 projects at the one end laterally beyond the machine frame 10 to facilitate a careful movement of the cutting device 2.

Chain guides 17, 18 for a continuous chain are arranged on the guide profiles on both sides of the machine frame 10. The chain guides 17,18 have clamping elements 19 which grip the lower foil 7 at its edges to effect a transporting of the lower foil. The containers are moved on cyclically with the help of the chains and are each positioned in the corresponding position of the cutting device 2.

A pressure clamping element 20 is fixedly connected to each guide profile 12. The pressure clamping element 20 consists of several piston cylinder units, which are connected in series, and a piston rod 21 common to all piston cylinder units. Each pressure clamping element 20 has a base 22 screwed to the guide profile 12. Two plates 23 connecting the pressure clamping element 20 with one another are secured on said base 22. The plates 23 are thus, through the base 22, stationarily fixed on the machine frame 10. The plates 23 are arranged parallel with one another and lie upright, as this can best be seen in FIG. 1. Two plates 24, 25 receiving and carrying the knife 4 of the cutting device are secured by means of screws 26 on the underside of the plates 23. The screws 26 extend into lateral shoulders 27 of the plates 23.

The lower tool part 5 consists of a plate extending beyond the width of the foils 6,7. The plate is, at its two sides, secured to the cylinder wall 28 of a pneumatic cylinder 29. The pneumatic cylinder has, in a conventional manner, a piston rod 30 and a piston 31 arranged at the end of the piston rod 30. The pneumatic cylinder is double-acting, and the piston rod 30 exits from the cylinder through a hermetically sealed gasket. The piston rod 30 is axially aligned with the piston rod 21 of the pressure clamping element and is fixedly connected to the piston rod 21 by means of a screw 32.

Figure 2:
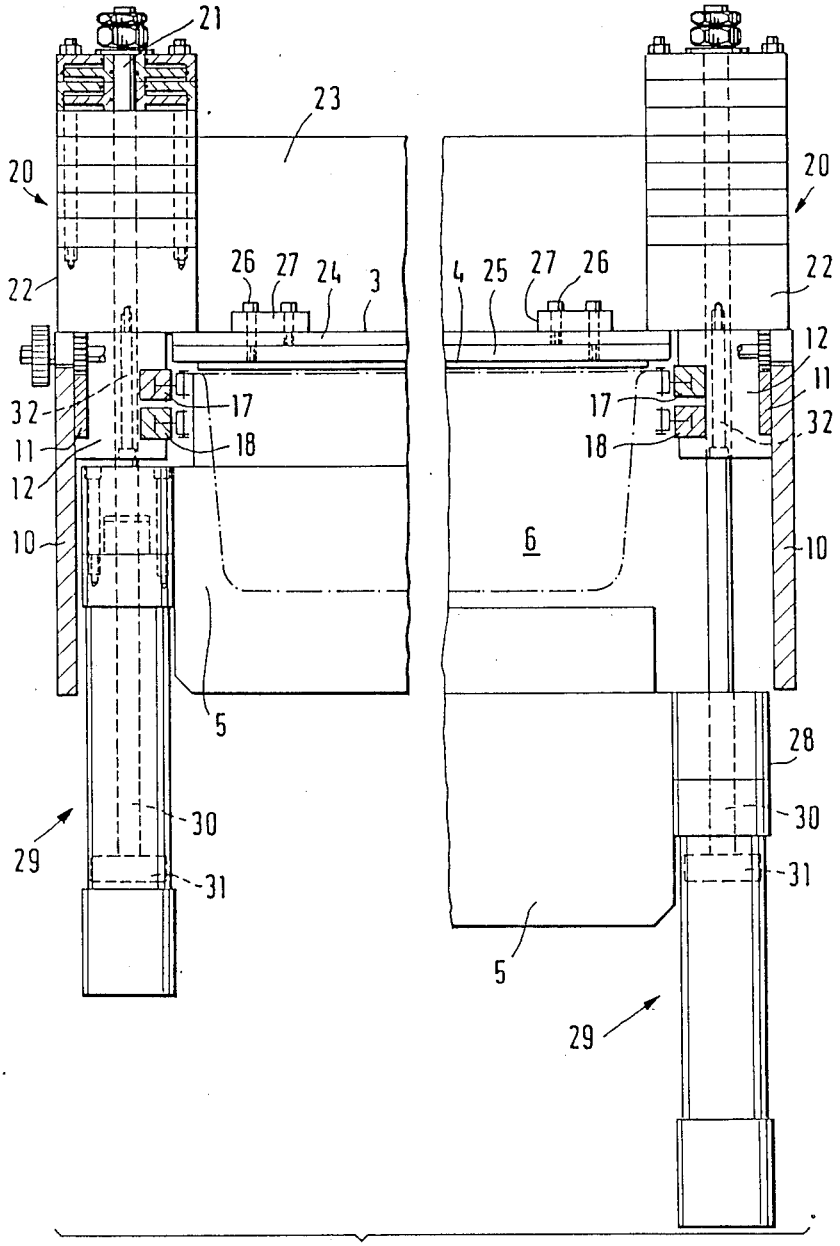
FIG. 2 is a cross-sectional view taken along the line II—II of FIG. 1.
Figure 3:
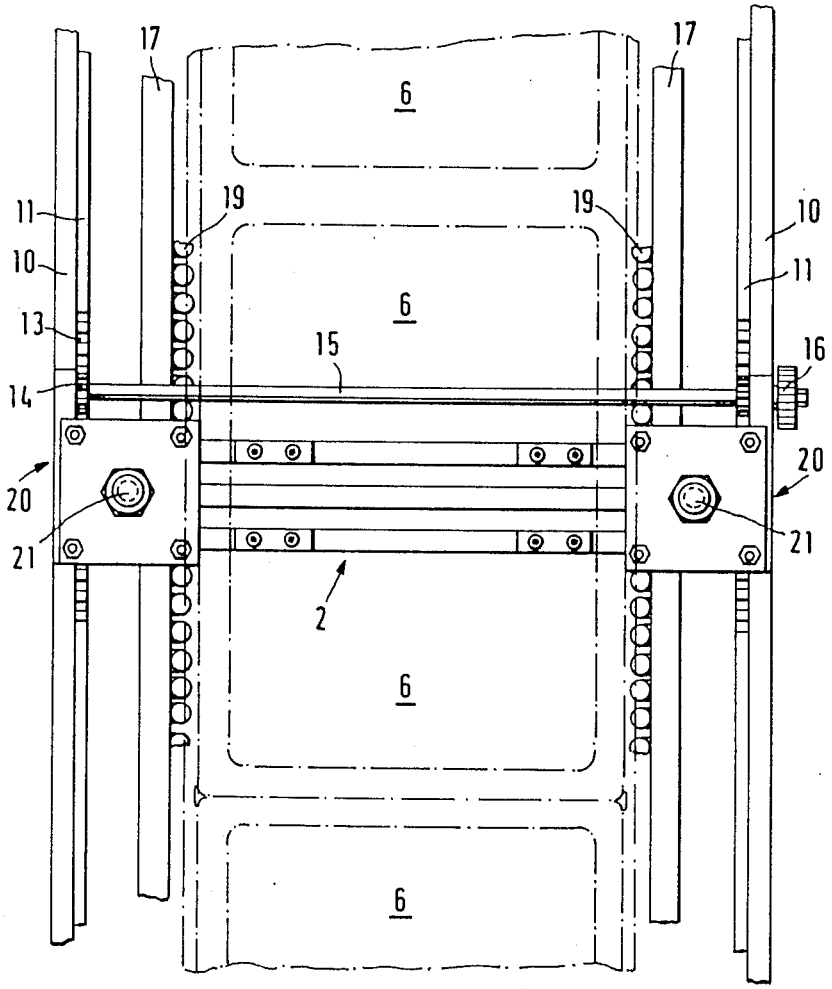
FIG. 3 is a view of the inventive cutting device.

FIGS. 1 and 2 each show in the left half of the drawing the lower tool parts in a lifted, that is, in the cutting position and in the right half of the drawing in a lowered position, that is, in a position facilitating the containers 6 being moved into the cutting device or being removed from the cutting device. FIG. 2 shows that the knife 4 is slightly narrower than the width of the lower foil, so that the packages are still connected at their edges and thus can also be further moved by means of the chains. Upon an operation of the pneumatic cylinder 29, the piston 31 maintains its position relative to the machine frame, while the cylinder wall 28 is lowered relative to the machine frame and thus the lower tool part 5 is lowered downwardly.

The length of the pneumatic cylinder piston 29 can be chosen as desired, so that here an opening gap of any desired size for the transport of the containers 6 can be obtained. The pneumatic cylinders 29 are loaded preferably with a relatively low pressure which, on the one hand, reduces the consumption of pressurized air and, on the other hand, has the result that the closing force of the pneumatic cylinder pistons can be held lower than 15 kp. It is here easily possible to save on special safety devices, because even if the hand of an operator moves during the closing operation between the lower and upper tool, damage cannot occur.

Figure 6:
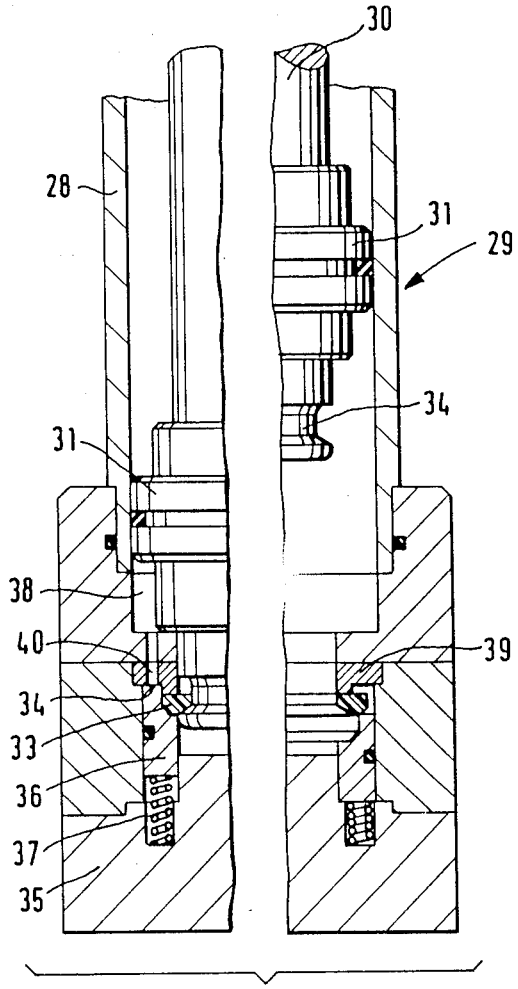
FIG. 6 illustrates a blocking device for fixing the piston rod of the pneumatic cylinder.
Figure 7:
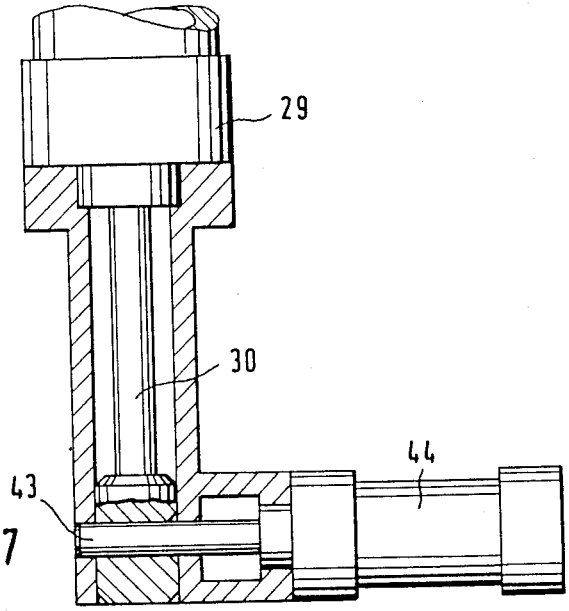
FIGS. 7 and 8 are two further embodiments for fixing the piston rod of the pneumatic cylinder.
Figure 8:
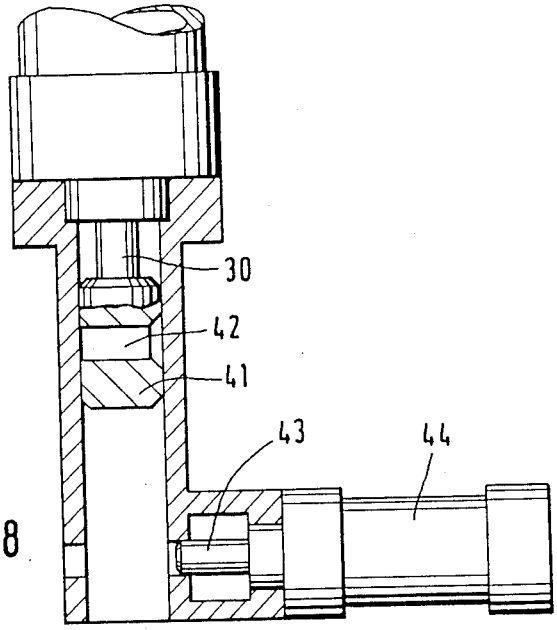

FIGS. 6 to 8 illustrate the lower ends of two different embodiments of the pneumatic cylinders. In the exemplary embodiment illustrated in FIG. 6, which again shows in the left half of the drawing the moved-in and in the right half of the drawing the moved-out position, the piston rod 30 is locked automatically in its lower end position, that is, in the position in which the two tool parts have been moved together. This is done through a ring 33 which is received in a groove 34 of the piston rod 30. A sleeve 36 is movably arranged in the end block 35 of the pneumatic cylinder 29. The sleeve cooperates with a spring 37. If no pressure exists in the cylinder chamber 38, the spring 37 presses the sleeve 36 upwardly, so that the ring 33 will be held in the groove 34 of the piston 31. The piston rod 30 is locked relative to the cylinder wall 28 and thus also at the same time the lower tool part 5 in this position of the ring 33. In spite of the low pressure, with which the pneumatic cylinder 29 is operated, a high cutting force can be built up through the pressure clamping element 20. A bore 40, arranged in an abutment part 39, is used to unlock the piston rod 30. Pressurized air acts through the bore 40 onto the sleeve 36, so that the spring 37 is compressed, as this is illustrated in the right half of FIG. 6 The ring 33 slides in this position out of the groove 34, so that the lower tool part 5 can be lowered.

FIGS. 7 and 8 illustrate a different embodiment of a lock for the piston rod 30. An eye 41 with a bore 42 is here arranged at the end of the piston rod 30. A bolt 43 can be moved into the bore and can be operated by a further pneumatic cylinder 44. The piston rod 30 is locked with respect to the cylinder wall 28 by inserting the bolt 43 in the lifted position of the lower tool part 5, that is, in the position in which the actual cutting force can be built up, so that the lower part 5 of the tool is now rigidly connected to the piston rod 30.

Figure 4:
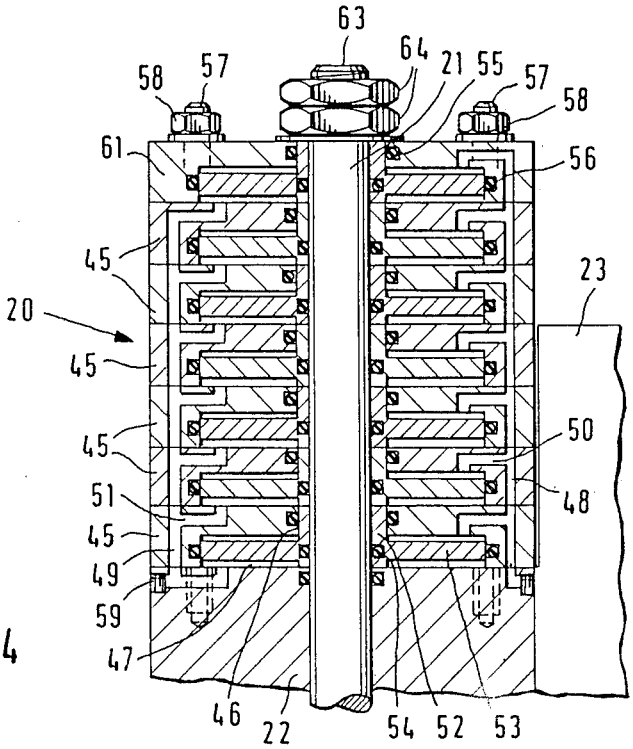
FIG. 4 is a detailed longitudinal cross-sectional view of the pressure clamping element.
Figure 5:
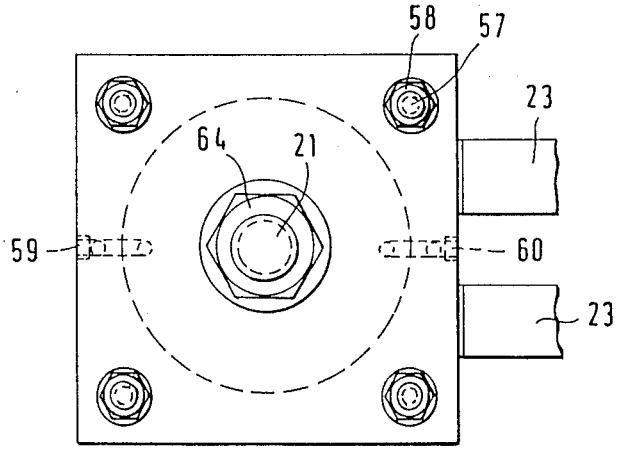
FIG. 5 is a top view of the clamping element according to FIG. 4.

The pressure clamping element 20 is shown enlarged in FIGS. 4 and 5. The pressure clamping element consists of a base 22 onto which a plurality of identically constructed ring elements 45 are mounted, seven in the exemplary embodiment. Each ring element has a center bore 46, a recess 47 arranged in one side and two through-going bores 48,49. Channels 50, 51 branch off from the through-going bores 48, 49 and are used to supply pressurized air to each side of the annular part 45.

The center bore 46 is constructed with such a size, that it serves, on the one hand, to receive the piston rod 21 and, on the other hand, to receive an annular sleeve 52 of a piston 53. The piston 53 has on its inside in the region of the sleeve 52 an O-ring seal 54 sealing off the piston with respect to the piston rod 21. Two further O-ring seals 55, 56 are arranged in the annular part 45 on the surfaces lying parallel with the piston rod. The O-ring seals 55, 56 are used to seal off the annular part with respect to the piston 53 and the sleeve 52 of the piston. All pistons 53 are supported on one another through their sleeves 52, so that the force of the individual piston cylinder units adds up, and so that with a relatively small diameter, by selecting the number of piston cylinder units, very high forces can be built up. The diameter of each piston cylinder unit is preferably chosen so that it delivers a pressure force of approximately 600 kp. at a pressure of 6 bar. Thus each pressure clamping element delivers in the illustrated exemplary embodiment approximately 4.2 t., so that all together a contact pressure of the knife 4 onto the lower tool part 5 of slightly over 8 t. is obtained.

Since a large opening gap for removing the containers 6 is achieved by the pneumatic cylinders being connected to the lower tool part, the path by which the pressure clamping element 20 delivers needs to be only very short. A path of 3 mm. has proven to be sufficient for cutting devices for packaging machines, so that the inventive pressure clamping device, with a comparatively small diameter and comparatively small structural height, can produce very high pressure forces needed for cutting of foils.

The pressure clamping element is moreover distinguished by great simplicity in its design, since it consists substantially of equal annular elements and pistons, which, depending on the needed pressure force, are stacked in any desired numbers on clamping screws 57 and are then clamped together by nuts 58 screwed onto clamping screws 57. Only two pneumatic connections 59, 60 are needed for all of the piston cylinder units, namely for double-acting cylinders. Thus each annular element 45 is constructed the same, whereby the annular elements are pressed together between the block 22 and an end piece 61, which basically can be constructed like the annular elements 45, however, with the bore 49 not being needed.

The piston rod 21 of the pressure clamping element 20 is guided through the pressure clamping element and has a thread 63 at its end, onto which two nuts 64 are screwed to fix the piston rod 21 on the pressure clamping element. This facilitates a simple mounting and demounting of the clamping element which, when completely mounted, can be attached or removed from the cutting device 2.

The embodiments of the invention in which an exclusive property or privilege is claimed are defined as follows:

1. In a pneumatic drive for punching, cutting and stamping devices comprising two tool parts which can be relatively moved toward and away from one another and of which at least one of said tool parts is fixedly connected to a machine frame, the improvement wherein at least one pneumatic cylinder is secured on a movable tool part, wherein a first piston rod is provided in said pneumatic cylinder, wherein a locking means is provided for locking said first piston rod in at least one end position thereof to said pneumatic cylinder, wherein at least one pressure clamping element is provided which has a second piston rod secured to said first piston rod exiting from said pneumatic cylinder, said pressure clamping element consisting of at least two piston cylinder units operatively connected with said second piston rod, said piston cylinder units including a fluid circuit means connecting said piston cylinder units in series so that an additive force is outputted on said second piston rod, whereby when said first piston rod is locked in said one end position, said piston cylinder units can be activated by supplying fluid to said fluid circuit means to cause said additive force to be outputted to said second piston rod, thereby causing said first piston rod, which is locked to said pneumatic cylinder, and said movable tool part, which is connected to said pneumatic cylinder, to be moved together toward said fixed tool part.

2. The pneumatic drive according to claim 1, wherein said pressure clamping element includes a cylinder which is comprised of annular individual parts connected together, each annular individual part having a center bore for receiving said second piston rod therein, a piston freely movable on said second piston rod and supported on an adjacent piston, each annular individual part further having a recess therein for receiving said piston therein.

3. The pneumatic drive according to claim 2, wherein each piston consists of a flat annular part and a cylindrical sleeve extending axially from both sides of said flat annular part, and wherein a bore extends axially through said flat annular part and said cylindrical sleeve.

4. A pneumatic drive according to claim 3, wherein said flat annular part and said cylindrical sleeve are of unitary construction.

5. A pneumatic drive according to claim 2, wherein each piston is sealed with respect to said second piston rod by an O-ring seal inserted into a bore in said piston.

6. A pneumatic drive according to claim 5, wherein further O-ring seals are inserted into offset inner surfaces of said recesses in each of said annular individual parts, said further O-ring seals providing an operative seal between said piston and its respective annular or individual part.

7. A pneumatic drive according to claim 2, wherein each cylindrical sleeve has a through-going bore adjacent a perimeter thereof for facilitating a loading of both sides of said piston with pressurized air.

8. A pneumatic drive according to claim 1, wherein at least two pneumatic cylinders are provided and are secured to said movable tool part, and wherein at least two pressure clamping elements are provided and are rigidly connected with one another.

9. A pneumatic drive according to claim 8, wherein said pneumatic cylinders connected to said movable tool part have a substantially larger stroke than said pressure clamping elements and are loaded with a relatively low pressure, so that a closing force of less than 15 kg. results.

10. A pneumatic drive according to claim 8, wherein said pressure clamping elements each have a relativley small cylinder volume and a stroke of approximately 3 mm., and wherein said piston cylinder units, which are connected in series, are each dimensioned such that, at a pressure of approximately 6 bar, a pressure force of approximately 600 kp. per piston unit is obtained.

11. A pneumatic drive according to claim 1, wherein said locking means for locking said first piston rod of said pneumatic cylinder includes an expandable and contractible ring movable into and out of an annular groove on said first piston rod, and means for effecting said movement of said ring.

12. A pneumatic drive according to claim 1, wherein said locking means includes a bolt receiving bore in said first piston rod, and a bolt movably guided in said pneumatic cylinder for movement into and out of said bolt receiving bore.

13. A pneumatic drive according to claim 12, wherein locking means further includes a drive means for said bolt, said drive means comprising a further pneumatic cylinder.

* * * * *

UNITED STATES PATENT AND TRADEMARK OFFICE

CERTIFICATE OF CORRECTION

PATENT NO. : 4 798 115

DATED : January 17, 1989

INVENTOR(S) : Alfred SCHMECK

It is certified that error appears in the above-identified patent and that said Letters Patent is hereby corrected as shown below:

Column 6, line 60; after "of" insert ---a---.

Column 7, line 1; delete "or".

Column 7, line 4; change "cylindrical sleeve" to ---annular individual part---.

Column 7, line 19; change "relativley" to ---relatively---.

Signed and Sealed this

Seventeenth Day of October, 1989

*Attest:*

DONALD J. QUIGG

*Attesting Officer*

*Commissioner of Patents and Trademarks*